US006619947B2

(12) United States Patent
Maldonado et al.

(10) Patent No.: US 6,619,947 B2
(45) Date of Patent: Sep. 16, 2003

(54) DUAL CAPILLARY SPINNERET WITH SINGLE OUTLET FOR PRODUCTION OF HOMOFILAMENT CRIMP FIBERS

(75) Inventors: Jose E. Maldonado, Canton, GA (US); Jeffrey D. Shelley, Cumming, GA (US); Richard Daniel Pike, Alpharetta, GA (US); Michael C. Cook, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 218 days.

(21) Appl. No.: 09/746,858

(22) Filed: Dec. 21, 2000

(65) Prior Publication Data

US 2002/0081927 A1 Jun. 27, 2002

(51) Int. Cl.[7] ..... D01D 5/22

(52) U.S. Cl. ..... 425/462; 425/DIG. 217; 425/463; 425/382.2

(58) Field of Search ..... 425/72.2, DIG. 217, 425/463, 464, 76, 382.2, 462

(56) References Cited

U.S. PATENT DOCUMENTS

| | | | | |
|---|---|---|---|---|
| 3,219,739 A | | 11/1965 | Breen et al. | 264/168 |
| 3,249,669 A | | 5/1966 | Jamieson | 264/177.13 |
| 3,338,992 A | | 8/1967 | Kinney | 264/441 |
| 3,341,394 A | | 9/1967 | Kinney | 442/366 |
| 3,387,327 A | | 6/1968 | Privott et al. | 425/131.5 |
| 3,502,538 A | | 3/1970 | Petersen | 428/359 |
| 3,502,763 A | | 3/1970 | Hartmann | 264/555 |
| 3,542,615 A | | 11/1970 | Dobo et al. | 156/181 |
| 3,692,618 A | | 9/1972 | Dorschner et al. | 442/401 |
| 3,802,817 A | | 4/1974 | Matsuki et al. | 425/66 |
| 3,849,241 A | | 11/1974 | Butin et al. | 428/137 |
| 3,920,784 A | | 11/1975 | Nakagawa et al. | 264/168 |
| 3,975,484 A | | 8/1976 | Okada et al. | 264/168 |
| 3,981,948 A | | 9/1976 | Phillips | 264/40.7 |
| 4,176,150 A | | 11/1979 | Bromley et al. | 264/168 |
| 4,179,259 A | | 12/1979 | Belitsin et al. | 425/461 |
| 4,265,849 A | | 5/1981 | Borenstein | 264/168 |
| 4,340,563 A | | 7/1982 | Appel et al. | 264/518 |
| 4,351,147 A | | 9/1982 | Blackmon et al. | 57/208 |
| 4,383,817 A | | 5/1983 | Mirhej | 425/463 |
| 4,522,773 A | | 6/1985 | Menezes et al. | 264/167 |
| 4,562,029 A | * | 12/1985 | Black | 264/167 |
| 4,619,803 A | | 10/1986 | Yu | 264/168 |
| 4,720,314 A | | 1/1988 | Black | 156/167 |
| 4,772,347 A | | 9/1988 | Fowler | 156/167 |
| 4,783,231 A | | 11/1988 | Raley | 156/167 |
| 4,973,236 A | | 11/1990 | Hasegawa et al. | 425/72.2 |
| 5,352,106 A | * | 10/1994 | Lenk et al. | 425/131.5 |
| 5,407,625 A | | 4/1995 | Travelute et al. | 264/168 |
| 5,633,082 A | * | 5/1997 | Berger | 428/365 |
| 5,989,004 A | | 11/1999 | Cook | 425/131.5 |
| 6,123,886 A | | 9/2000 | Slack | 264/168 |

FOREIGN PATENT DOCUMENTS

| | | |
|---|---|---|
| CA | 1278659 | 1/1991 |
| DE | 1 219 165 | 6/1966 |
| EP | 600 331 | 8/1997 |
| EP | 748 272 | 10/1999 |
| GB | 936729 | 9/1963 |
| GB | 1226726 | 6/1969 |
| WO | 98/38358 | 9/1998 |
| WO | 98/45512 | 10/1998 |

* cited by examiner

*Primary Examiner*—Robert Davis
*Assistant Examiner*—Joseph S. Del Sole
(74) *Attorney, Agent, or Firm*—Pauley Petersen Kinne & Erickson

(57) ABSTRACT

Robust round homofilament fibers are meltspun from a spinneret having two conjoined capillaries of different length to diameter ratio to induce differential shear to produce fiber crimping. Crimping may further be aided by quenching of the fibers.

6 Claims, 2 Drawing Sheets

DUAL CAPILLARY SPINNERET WITH SINGLE OUTLET FOR PRODUCTION OF HOMOFILAMENT CRIMP FIBERS

FIELD OF THE INVENTION

The present invention relates generally to lofty nonwoven fiber webs. The present invention relates specifically to lofty nonwoven fiber webs of homofilament crimped fibers and two capillary, single hole means and method for producing the fibers.

BACKGROUND OF THE INVENTION

Webs of homofilament crimped thermoplastic fibers are useful for various fluid handling or retaining materials and the like because of their open structure, resiliency, and economy of manufacture. Particularly, the use of a single thermoplastic polymer in the making of the crimped fibers is good for economical and consistent manufacture. However, the present state of the manufacturing art relies largely on bicomponent filaments to induce the desired level of crimping in a consistent fashion leading to certain compromises in the consistency of fabric characteristics and economy thereof.

In the known art several attempts have been made to produce crimping through shaped fibers. Spinnerets having shaped orifices or multiple orifices to produce the shaped fibers are also known. However the known art suffers in several regards. First, the known processing of the shaped fibers is not a robust process in that the fibers are not consistently shaped or the component parts of the fiber do not hold together well, resulting in less predictable web morphology and attendant functional characteristics. Second, the degree of crimping derived from using a single polymer to produce a crimped homofilament has not always attained the desired level.

Therefore, there is a need in the art for a robust and easily accomplished means and method of manufacturing homofilament crimped fiber which has a high degree of crimp and good predictability of the fiber shape and crimping to yield the desired nonwoven web structure.

DEFINITIONS

Within the context of this specification, each term or phrase below will include the following meaning or meanings.

"Article" refers to a garment or other end-use article of manufacture, including but not limited to, diapers, training pants, swim wear, catamenial products, medical garments or wraps, and the like.

"Bonded" or "bonding" refers to the joining, adhering, connecting, attaching, or the like, of two elements. Two elements will be considered to be bonded together when they are bonded directly to one another or indirectly to one another, such as when each is directly bonded to intermediate elements.

"Connected" refers to the joining, adhering, bonding, attaching, or the like, of two elements. Two elements will be considered to be connected together when they are connected directly to one another or indirectly to one another, such as when each is directly connected to intermediate elements.

"Disposable" refers to articles which are designed to be discarded after a limited use rather than being laundered or otherwise restored for reuse.

"Disposed," "disposed on," and variations thereof are intended to mean that one element can be integral with another element, or that one element can be a separate structure bonded to or placed with or placed near another element.

"Fabrics" is used to refer to all of the woven, knitted and nonwoven fibrous webs.

"Homofilament" refers to a fiber formed from only one predominate polymer and made from a single stream of that polymer. This is not meant to exclude fibers formed from one polymer to which small amounts of additives have been added for coloration, anti-static properties, lubrication, hydrophilicity, etc.

"Integral" or "integrally" is used to refer to various portions of a single unitary element rather than separate structures bonded to or placed with or placed near one another.

"Layer" when used in the singular can have the dual meaning of a single element or a plurality of elements.

"Longitudinal" and "transverse" have their customary meaning, as indicated by the longitudinal and transverse axes depicted in FIG. 3. The longitudinal, or long, axis lies in the plane of the article and is generally parallel to a vertical plane that bisects a standing wearer into left and right body halves, when the article is worn. The transverse axis lies in the plane of the article generally perpendicular to the longitudinal axis. The article, although illustrated as longer in the longitudinal direction than in the transverse direction, need not be so.

"Machine direction" refers to the length of a fabric in the direction in which it is produced, as opposed to "cross direction" which refers to the width of a fabric in a direction generally perpendicular to the machine direction.

"Meltblown fiber" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin et al. Meltblown fibers are microfibers which may be continuous or discontinuous, are generally smaller than about 0.6 denier, and are generally self bonding when deposited onto a collecting surface. Meltblown fibers used in the present invention are preferably substantially continuous in length.

"Meltspun" refers generically to a fiber which is formed from a molten polymer by a fiber-forming extrusion process, for example, such as are made by the meltblown and spunbond processes.

"Member" when used in the singular can have the dual meaning of a single element or a plurality of elements.

"Nonwoven" and "nonwoven web" refer to materials and webs of material which are formed without the aid of a textile weaving or knitting process.

"Polymers" include, but are not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

Words of degree, such as "About", "Substantially", and the like are used herein in the sense of "at, or nearly at, when given the manufacturing and material tolerances inherent in the stated circumstances" and are used to prevent the unscrupulous infringer from unfairly taking advantage of the invention disclosure where exact or absolute figures are stated as an aid to understanding the invention.

"Spunbond fiber" refers to small diameter fibers which are formed by extruding molten thermoplastic material as filaments from a plurality of fine capillaries of a spinneret having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartmann, U.S. Pat. No. 3,502,538 to Petersen, and U.S. Pat. No. 3,542,615 to Dobo et al., each of which is incorporated herein in its entirety by reference. Spunbond fibers are quenched and generally not tacky when they are deposited onto a collecting surface. Spunbond fibers are generally continuous and often have average deniers larger than about 0.3, more particularly, between about 0.6 and 10.

"Surface" includes any layer, film, woven, nonwoven, laminate, composite, or the like, whether pervious or impervious to air, gas, and/or liquids.

"Thermoplastic" describes a material that softens when exposed to heat and which substantially returns to a non-softened condition when cooled to room temperature.

These terms may be defined with additional language in the remaining portions of the specification.

SUMMARY OF THE INVENTION

A homofilament crimped fiber is produced by joining polymer streams from two capillaries, each having different length to diameter ratios (L/D) with the joined streams exiting through a single outlet, or hole, in the meltspun die head. Due to the different capillary structures, differently induced shear in the different polymer streams results in differential polymer orientation, crystallinity percentage and resultant differential tensions in the joined halves of the filament. The filaments may further be subjected to quenching which provides for setting the crimps in the filaments to further induce the crimp. The filaments in one embodiment retain a substantially round shape by exiting through a round hole thus resulting in a more robust and predictable filament although the fiber shape need not be so limited according to certain aspects of the present invention.

The two capillary spinneret design for producing a crimped homofilament fiber according to the present invention has a first capillary and a second capillary fed by a single counterbore but joined near their exit to have a single filament formed from the commingled liquid polymer extrusion.

DETAILED DESCRIPTION OF THE PRESENTLY PREFERRED EMBODIMENTS

The present invention provides a method of producing homofilament helical crimped nonwoven web. The present invention is usable with meltspun polymers known to those skilled in the art and most surprisingly works well with polypropylene polymers. In general, the means and method of the present invention comprise using two conjoined capillaries for inducing differential shear between polymer streams extruded from a single exit hole in the meltspun die head.

In a preferred embodiment of the present invention, the fibers may be formed of resin which is preferably a thermoplastic polypropylene polymer. Other polymers such as, but not limited to, polyolefins, polyesters, polyamides, polyurethanes, copolymers and mixtures thereof might also be used in accordance with certain aspects of the present invention.

Figure 1:
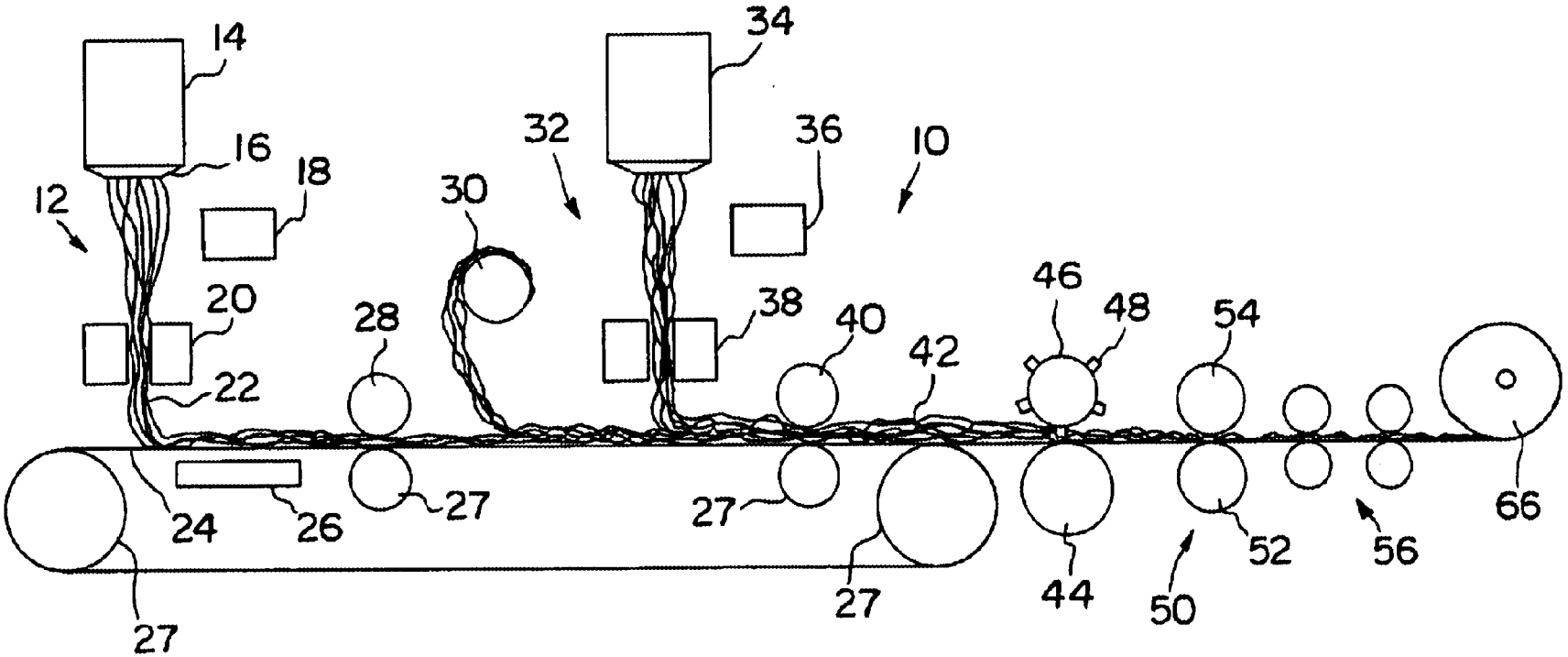
FIG. 1 (Prior Art)
FIG. 1 shows a known apparatus of the general environment used for manufacturing filaments according to the present invention.

FIG. 1 shows an apparatus of the general environment used for manufacturing filaments, or "fibers" as used synonymously therewith, according to the present invention. Apparatus 10 has a first assembly 12 for producing spunbond fibers in accordance with known methods. A spinneret 14 is supplied with molten polymer resin from a resin source (not shown). The spinneret 14 produces fine denier fibers from the exit 16, which are quenched by an air stream supplied by a quench blower 18. Crimping, as discussed in general hereinabove, creates a softer fabric by reducing the "straightness" of the fibers, between bond points created in the thermal bonding step, as well as fiber-to-fiber bonds. Various parameters of the quench blower 18 can be controlled to control the quality and quantity of crimping. Fiber composition and resin selection also determine the crimping characteristics imparted.

The filaments are drawn into a fiber drawing unit or aspirator 20 having a Venturi tube/channel 22, through which the fibers pass. The tube is supplied with controlled air, which attenuates the filaments as they are pulled through the fiber drawing unit 20. The attenuated fibers are then deposited onto a foraminous moving collection belt 24 and retained on the belt 24 by a vacuum force exerted by a vacuum box 26. The belt 24 travels around guide rollers 27. As the fibers move along on the belt 24, a compaction roll 28 above the belt, which operates with one of the guide rollers 27 beneath the belt, typically compresses the spunbond mat so that the fibers have sufficient integrity to go through the manufacturing process.

Figure 2:
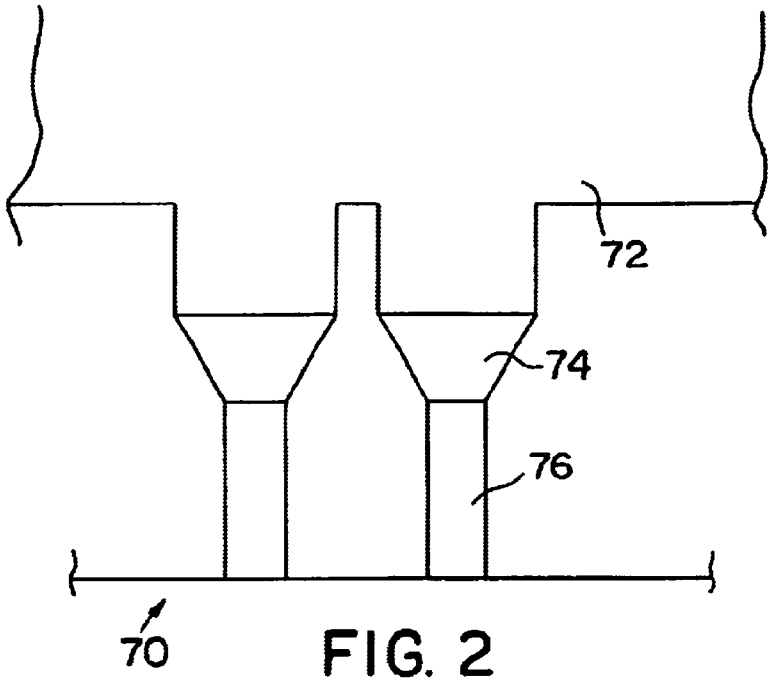
FIG. 2 (Prior Art)
FIG. 2 is a schematic representation of a cross sectional view of the fiber forming capillaries and surrounding elements of a typical meltspun die.

As shown in FIG. 2, die tip 70 defines a polymer supply passage 72 that terminates in further passages defined by counterbores 74 connected to capillaries 76. Capillaries 76 are individual passages formed in, and generally running the length of, die tip 70. Generally, in the known art it is desirable that single capillaries have a length to diameter ratio of from about 4:1 to about 12:1, and more desirably about 6:1 to about 10:1, with length being defined in the direction of polymer flow and width being the diameter of the capillary.

Figure 3:
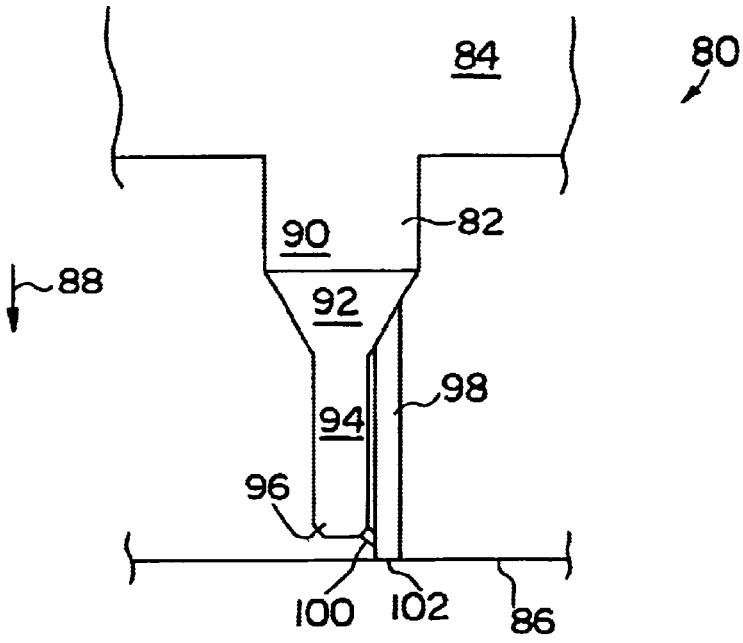
FIG. 3 is an exemplary two capillary-single hole spinneret design for producing crimped homofilament fibers according to the present invention.

Referencing FIG. 3, detailing a portion of an exemplary die head 80 according to the present invention as set up for polypropylene homofilament spunbond crimped filament production, a counter bore 82 is located in the die head between the polymer supply channel 84 and the extrusion, or knife, edge 86, thus having its longitudinal axis in, or defining, the direction of polymer flow, as indicated by arrow 88. The counter bore 82 does not reach, or open to, the knife edge 86. In the direction of polymer flow, the counter bore 82 has a first channel 90 of about 4.00 mm diameter adjacent and connected to the polymer supply channel 84. The first channel 90 leads to a first conical feed chamber 92 whose wall slopes inwardly and downwardly by about 2.16 mm at a 60° angle to lead to a second, narrower, channel 94 of about 1.50 mm diameter and 7.43 mm length. The second channel 94 ends in a second conical feed chamber 96 whose walls also slope inwardly at about 60° to end in a flat bottom about 0.54 mm in from the knife edge 86.

The first capillary 98 of about 0.60 mm diameter is connected to the first feed chamber 92 at about the midpoint thereof and extends parallel to the counter bore long axis to open to the air at the knife edge 86, for a total length of about 6.36 mm.

The second capillary 100 of about 0.20 mm diameter and 0.30 mm length is connected to the second feed chamber 96 conical wall and extends downwardly at about a 45° angle to connect with the first capillary 98 at about 0.41 mm above the knife edge, or first capillary exit hole 102.

Thus, in the illustrated embodiment the first capillary has an L/D ratio of about 10 to 1, while the second capillary has an L/D ratio of about 1.5 to 1. The L/D ratio of the capillaries may be varied according to the present invention to achieve the desired durability, processability and desired crystallinity percentage within the fiber. "Crystallinity percentage" represents the amount, or percent, of crystals formed in the polymer chain. The capillaries or the exit hole may further be shaped rather than round to induce further crimping.

The higher shear produced in the polymer by travel through the shorter, narrower second capillary will lower the viscosity of the polymer melt and induce higher polymer chain orientation than polymer travel through the larger, wider first capillary which has higher viscosity and lower polymer chain orientation resulting in a more amorphous polymer stream. As the commingled polymer stream exits to the air, and is preferably quenched on both sides to fix the orientation of the extrudate, the highly oriented side will shrink to a greater degree causing crimping of the fiber. The high loft fiber is then gathered into a nonwoven web which may be useful for such applications as hook and loop fastener fabric, filtration material, or as any of several layers in disposable absorbent garments such as surge, liner, cover or spacer layers.

Having thus described means and method for producing homofilament crimped thermoplastic fibers through the use of two conjoined capillaries using a single exit hole, it will be appreciated that while this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A spinneret design for producing a crimped homofilament fiber comprising:

a) an extruder for forcing a liquid polymer through spinneret capillaries;

b) a fiber forming portion consisting of:

i) a counterbore connected to a polymer supply channel, the counterbore longitudinal axis defining a polymer flow axis, the counterbore having a first channel connected to a polymer supply channel and a second channel narrower than the first channel, the second channel connected to the first channel by a first conical feed chamber, the second channel ending in a second conical feed chamber;

ii) a first capillary connected to the first conical feed chamber and having an exit hole out of the die head, the first capillary having a length to diameter ratio of between about 6:1 to about 10:1, the first capillary longitudinal axis being parallel to the flow axis;

(iii) a second capillary connected between the first capillary at a point prior to the exit hole and the second feed chamber, the second capillary having a length to diameter ratio of about 1.5:1 to achieve a desired crystallinity percentage within the fiber; and whereby liquid polymer extrusions from the first capillary and the second capillary commingle to form a single filament having sections of different induced shear thereby causing the filament to crimp.

2. The spinneret design for producing a crimped homofilament fiber according to claim 1 wherein: the second capillary diameter is only about ⅓ of the first capillary diameter.

3. The spinneret design for producing a crimped homofilament fiber according to claim 1 wherein: the second capillary joins the first capillary at an angle of about 45 degrees to the flow axis.

4. The spinneret design for producing a crimped homofilament fiber according to claim 1 wherein the exit hole is round.

5. The spinneret design for producing a crimped homofilament fiber according to claim 1 wherein: the capillaries are round in a cross section perpendicular to a direction of flow of the capillaries.

6. The spinneret design for producing a crimped homofilament fiber according to claim 1 wherein: the conical feed chambers have walls angled to each other at 60 degrees.

* * * * *